US009339165B2

(12) United States Patent
Vetter et al.

(10) Patent No.: US 9,339,165 B2
(45) Date of Patent: May 17, 2016

(54) REPLACEABLE CLEANING PADS FOR CLEANING DEVICE

(71) Applicant: The Procter & Gamble Company, Cincinnati, OH (US)

(72) Inventors: Kerry Andrew Vetter, Cincinnati, OH (US); David John Hoying, Cincinnati, OH (US); Roberto Manuel Matos, Cincinnati, OH (US); Mimi Gizaw Daniel, Cincinnati, OH (US); Hirotaka Uchiyama, Loveland, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 487 days.

(21) Appl. No.: 13/850,409

(22) Filed: Mar. 26, 2013

(65) Prior Publication Data

US 2014/0289984 A1 Oct. 2, 2014

(51) Int. Cl.

| | |
|---|---|
| ***A47L 13/16*** | (2006.01) |
| ***A47L 13/17*** | (2006.01) |
| ***A47L 13/22*** | (2006.01) |
| ***A47L 13/44*** | (2006.01) |

(52) U.S. Cl.

CPC ..... *A47L 13/16* (2013.01); *A47L 13/17* (2013.01); *A47L 13/22* (2013.01); *A47L 13/44* (2013.01)

(58) Field of Classification Search

CPC ..... A47L 13/16; A47L 13/22; A47L 13/17; A47L 13/44

See application file for complete search history.

(56) References Cited

U.S. PATENT DOCUMENTS

| | | | | |
|---|---|---|---|---|
| 5,066,527 | A | 11/1991 | Newell | |
| 5,094,559 | A | 3/1992 | Rivera et al. | |
| 2004/0074520 | A1 | 4/2004 | Truong et al. | |
| 2004/0128786 | A1 * | 7/2004 | Policicchio | A47L 13/20 15/228 |
| 2006/0000043 | A1 * | 1/2006 | Jou-Chen | A47L 13/51 15/231 |

FOREIGN PATENT DOCUMENTS

| | | | |
|---|---|---|---|
| EP | 1238621 | A1 | 9/2002 |

OTHER PUBLICATIONS

PCT Search Report dated Oct. 16, 2014; PCT-2014/031847; 5 Pages.
U.S. Appl. No. 13/850,419, filed Mar. 26, 2013, Vetter, et al.

* cited by examiner

*Primary Examiner* — Randall Chin
(74) *Attorney, Agent, or Firm* — Larry L. Huston; Steven W. Miller

(57) ABSTRACT

A pad for cleaning a hard target surface. The pad may be removably attached to a device for cleaning debris from a target surface. The pad has a predetermined 90 degree peel force to prevent undue removal force from the device and prevent the pad from coming loose during the cleaning task.

13 Claims, 7 Drawing Sheets

REPLACEABLE CLEANING PADS FOR CLEANING DEVICE

FIELD OF THE INVENTION

The present invention relates to cleaning pads and more particularly to cleaning pads removably attachable to a cleaning device.

Cleaning pads for hard surfaces are well known in the art. The cleaning pads may be handheld or removably attached to a cleaning device. The device may improve ergonomics and/or convenience. If the cleaning pad is removably attached to a device, the pad must be easy to remove for discard, yet easy to attach for replenishment. If the application force is too great, it will be inconvenient to replace the pad when needed, even if proper removal force results.

If the removal force, such as peel force, is too small, the cleaning pad may become loose during the cleaning task and be less efficacious. If the removal force is too great, it may require undue effort by the user and/or tear the pad upon removal.

Accordingly, the cleaning pad may have a removal force which is neither too small nor to large, coupled with a suitable application force.

SUMMARY OF THE INVENTION

The invention comprises a pad for and optionally in conjunction with a cleaning implement. The pad has a removal force which is advantageously convenient for pad replacement.

BRIEF DESCRIPTION OF THE DRAWINGS

FIGS. 2 through 5 are drawn to scale. FIGS. 6-7 are photographed to scale.

DETAILED DESCRIPTION OF THE INVENTION

Figure 1A:
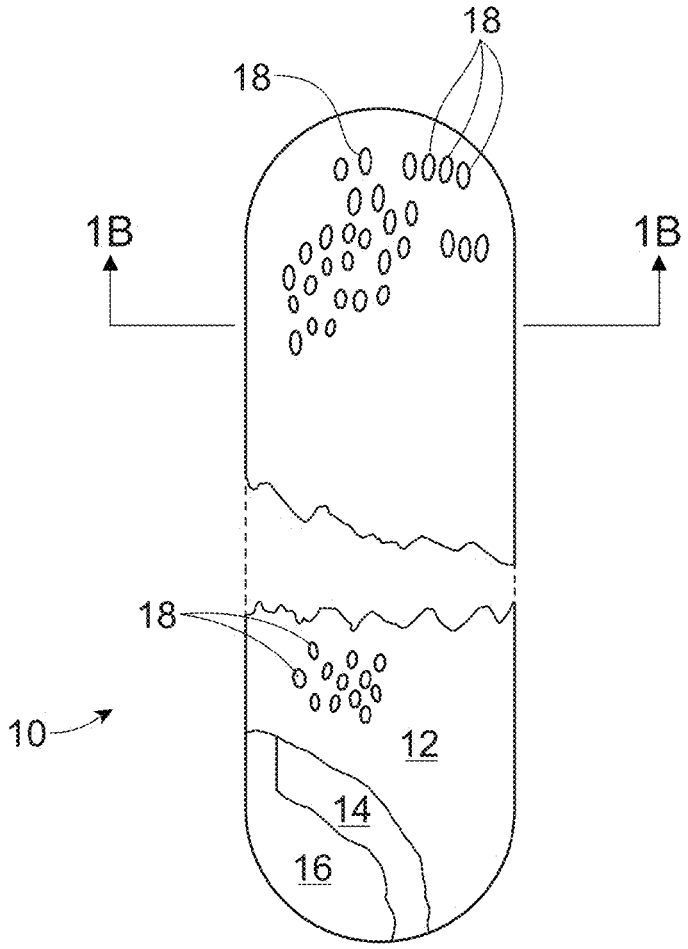
FIG. 1A is a broken top plan view, shown partially in cutaway, of a cleaning pad according to the present invention.
Figure 1B:
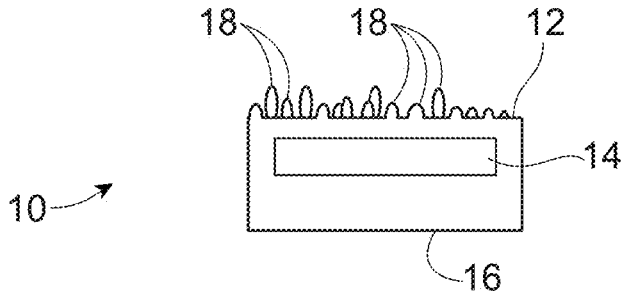
FIG. 1B is a schematic sectional view, taken through lines 1B-1B of FIG. 1A.

Referring to FIGS. 1A-1B, the cleaning pad (10) according to the present invention may have a topsheet (12) with outwardly extending protuberances (18). The pad (10) may optionally comprise a backsheet (16). Optionally, the pad (10) may comprise a core (14) intermediate the topsheet (12) and backsheet (16), or a core (14) and no backsheet (16).

The topsheet (12) contacts the soiled surface during cleaning, and interacts with the soil and the cleaning solution. As such, materials useful as the topsheet (12) may be sufficiently durable that this layer retains its integrity during the cleaning process. In addition, when the topsheet (12) is used in combination with a cleanser, the topsheet (12) may absorb liquids and soils, and transport those liquids and soils to the core (14) and/or towards the backsheet (16). The topsheet (12) will, in addition to removing particulate matter, facilitate other functions, such as polishing, dusting, disinfecting, sanitizing and/or buffing the target surface being cleaned or otherwise treated.

The topsheet (12), and particularly protuberances (18) thereof, contact the target surface during cleaning. The topsheet (12) may be any sheet having the ability to form protuberances (18) therein. The topsheet (12) may comprise, for example, a formed film, nonwoven or tissue sheet.

The topsheet (12) may be liquid pervious, to allow cleaning liquids to penetrate therethough during cleaning. The cleaning liquids may thus foam and provide for sudsing. Dirty/contaminated cleaning solution may be stored in the optional core (14), if present or between the core (14) and backsheet (16).

A suitable nonwoven for the topsheet (12) may be made of spunbonded polyester, such as is available from Fiberweb (London, England) under the name Reemay® 2214. Prophetically, the topsheet (12) may be made of a PET nonwoven material having round fibers. The topsheet (12) may have a basis weight ranging from 40 to 60 gsm, and may particularly be 46 gsm. The nonwoven material may have a denier ranging from 1.5 to 4 and particularly may be 2.2 denier. The nonwoven material may have a MD elongation at break ranging from 80 to 150 percent, 100 to 130 percent or 110 to 120 percent. It has been found that a topsheet (12) having an elongation outside either limit of the broadest aforementioned range does not produce efficacious cleaning.

The topsheet (12) may comprise a single lamina. By single lamina, it is meant that two formed and independent strata are not joined together in face-to-face relationship. Instead, a single ply is utilized. It is understood that the single ply may comprise plural layers of fibers therein.

If desired, the topsheet (12) may further comprise discrete apertures. The floor sheet may comprise from 5 to 20 holes per square centimeter, more particularly from 7 to 15 holes per square centimeter. The apertures may be tapered or funnel-shaped apertures, meaning that the diameter at the lower end of the aperture (i.e. closer to the surface to be cleaned) is greater than the diameter at the upper end of the aperture (i.e. closer to the core (14) layer(s)) and balance of the cleaning pad (10). The apertures may provide a suctioning or capillary transport effect as the cleaning pad (10) is moved across the surface being cleaned. The capillary transport effect aids in moving liquid from the surface being cleaned to other layer(s) of the cleaning pad (10), such as the absorbent layer(s), if present. In addition, tapered or funnel-shaped apertures may provide resistance to reduce the occurrence of liquids passing back through the topsheet (12) and onto to the surface being cleaned.

The protuberances (18) may be made using solid state formation, as is known in the art. Solid state formation relies upon interdigitating rolls to plastically deform protuberances (18) into a suitable sheet. The sheet may comprise, for example, a formed film, nonwoven or tissue sheet.

The protuberances (18) may be formed according to any of U.S. application Ser. No. 13/094,206 filed Apr. 26, 2011, US 2012-0064298 A1, now U.S. Pat. No. 9,067,357 "Method for Deforming a Web," U.S. application Ser. No. 13/094,477 filed Apr. 26, 2011, US 2012-0273997, now U.S. Pat. No. 9,044,353 A1 "Process for Making a Micro-Textured Web," U.S. application Ser. No. 13/094,559 filed Apr. 26, 2011, US 2012-0276239 A1, now U.S. Pat. No. 8,708,687 "Apparatus for Making a Micro-Textured Web," U.S. application Ser. No. 13/094,593 filed Apr. 26, 2011, now US publication 2012-0277701 A1 and now pending and/or US 2012-0277701 A1 "Formed Web Comprising Chads" One suitable topsheet (12) is a 46 gsm PET spunbond nonwoven having 2.5 mm protuberances (18).

The protuberances (18) may be discrete, extending outwardly from a proximal end disposed on a continuous background network to a distal end remote therefrom. The background may be thought of as being continuous, while the protuberances (18) may be thought of as being discrete and spaced apart from adjacent protuberances (18). The protuberances (18) may be of a common height/profile or of variable height/profile, as shown.

The protuberances (18) may comprise the entire topsheet (12) or one or more portions thereof to form a scrubbing strip. The protuberances (18) may cover all of or only a portion of the topsheet (12). The scrubbing strip may be coterminous with and have the same length as the long dimension of the topsheet (12). Alternatively, the protuberances (18) may have a width ranging from 1 to 15 cm, and comprise 5 to 90 or 10 to 50 percent of the width of the topsheet (12).

Alternatively, the protuberances (18) may comprise the entire area of the topsheet (12). Alternatively, the protuberances (18) may extend throughout the long dimension of the topsheet (12) and be generally centered thereon.

The protuberances (18) may be disposed in a nonrandom, repeating pattern. The protuberances (18) may be unilaterally staggered or bilaterally staggered. The protuberances (18) may be round, square, rectangular, oval or of any other desired shape. The protuberances (18) may have an aspect ratio, defined as the ratio of the height of the protuberance (18) to the major dimension of the protuberance (18) parallel to the plane of the strip, ranging from 0.19 to 1 and particularly from 0.16 to 1.

The protuberances (18) may be discrete and spaced apart from adjacent protuberances (18). The protuberances (18) may have a height of at least 0.5, 1 or 1.5 mm, but less than 5, 4, or 3 mm and may be 2.5 mm. The topsheet (12) may comprise from 25 to 45, or from 30 to 40 and particularly 36 protuberances (18) per 25 square cm.

The orientation of the major axis of the protuberances (18) relative to the stroke direction of the user during cleaning is not critical. Grout lines, texture in tile, grooves in linoleum flooring, other asperities and irregularities, etc. typically occur in both the longitudinal and transverse directions. Thus, whether the major axis is aligned in the longitudinal direction of the cleaning pad, transverse direction, is skewed or diagonal relative thereto, is immaterial.

The topsheet (12) may be made generally according to the teaching of commonly assigned U.S. application Ser. No. 13/289,331, P&G Case 12296, now U.S. Pat. No. 9,204,775. The topsheet (12) may particularly be made according to the description of the scrubbing strip in this application, which description is particularly found at page 9, line 21-page 10, line 12 and at page 11 lines 10-31. The protuberances (18) may be made according to the protrusion description found in FIG. 2 and page 10, line 24-page 11, line 8.

To measure protuberance (18) properties, samples of the topsheet (12) should be equilibrated at 23° C.+/−2 C.° and 50%+/−2% relative humidity for at least 2 hours immediately before testing, or prior to acquiring measurements. Samples of the topsheet (12), obtained from either finished-product cleaning pads (10), or of unassembled topsheet (12) material, can be measured. For either sample type, the area of topsheet (12) in each sample will ideally have a first dimension of at least 200 mm and a dimension perpendicular thereto of at least 200 mm. If the area of within the sample is smaller than these ideal dimensions then the maximum size feasible for each dimension is utilized, while restricting the measurement to solely the area of having protuberances (18), and excluding other areas which might be present on the cleaning sheet.

If the cleaning pad (10) is pre-wetted as presented to the user, the cleaning pad (10) is dried before testing. Drying may be accomplished by laying the cleaning pad (10) on a flat, horizontal surface with the scrubbing strip 10 facing upwards. The room in which the cleaning pad (10) is dried to is kept at conditions of 23+/−2 C.° and a RH of 50+2 percent. The cleaning pad (10) is dried until dry to the touch.

The topsheet (12) sample to be measured is placed with the target-facing cleaning surface upward. The topsheet (12) sample is flat, free of creases/wrinkles and not stretched. All measurements are made at a single location on the topsheet (12), and the entire process is repeated at 10 replicate locations on the topsheet (12) and averaged for each specific property.

A Mitutoyo Absolute measuring device available from Mitutoyo America Corp. of Aurora, Ill., Model ID-C1012E/code 543-272 may be used. The device has a round presser foot with an area of 13.8 square centimeters and a weight of 11.35 g.

The protuberance free height is defined as the initial baseline caliper value measured under the weight of the only the device presser foot, as shown in Table 1. The baseline sample caliper is recorded as the protuberance (18) free height, using only the presser foot of the device. Weights are then provided in accord with Table 1.

TABLE 1

| Weight no. | Weight [g] | Applied pressure [kpa] |
|---|---|---|
| Presser Foot | 11.35 | 0.28 |
| 1 | 35.96 | 0.62 |
| 2 | 90.38 | 1.65 |
| 3 | 232.30 | 2.48 |
| 4 | 352.18 | 4.07 |
| 5 | 569.06 | 5.58 |

Weights 1-5 are cumulatively added to the presser foot, in turn. The caliper of the pad (10) is recorded after each weight is added to the previous weight in turn as the first compressed height at the respective compressive pressure.

Weights 5-1 are successively removed from the presser foot, in turn. The caliper of the pad (10) is recorded after each weight is removed from the previous weight in turn as the uncompressed height at the respective compressive pressure.

The resiliency of the protuberances (18) may be calculated according to the formula:

$$\frac{\text{Caliper after removing all weights} - \text{Caliper after adding all weights}}{\text{Free height} - \text{Caliper after adding all weights}} \times 100 = \text{resiliency.}$$

The resiliency may range from 15 to 45%, 20 to 30% and may be 26%.

Figure 2:
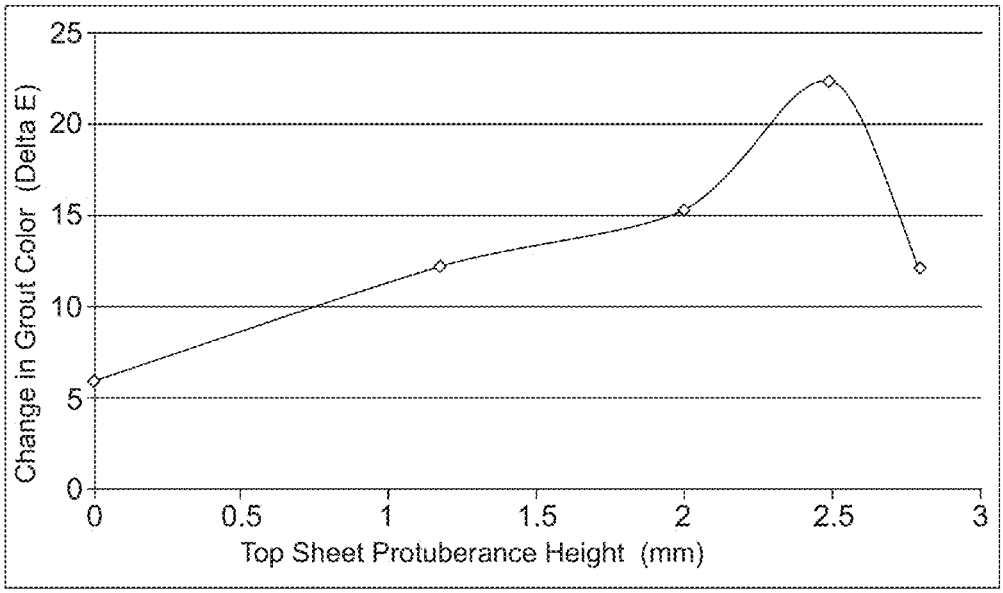
FIG. 2 is a graphical representation of the cleaning performance of cleaning pads having five different protuberance heights.

Referring to FIG. 2, suitable protuberances (18) according to the present invention may have a protuberance (18) free height of about 2.5+/−0.3 mm and more particularly about 2.5+/−0.1 mm. It can be seen that protuberances (18) in this range provide unexpected cleaning performance.

Figure 3:
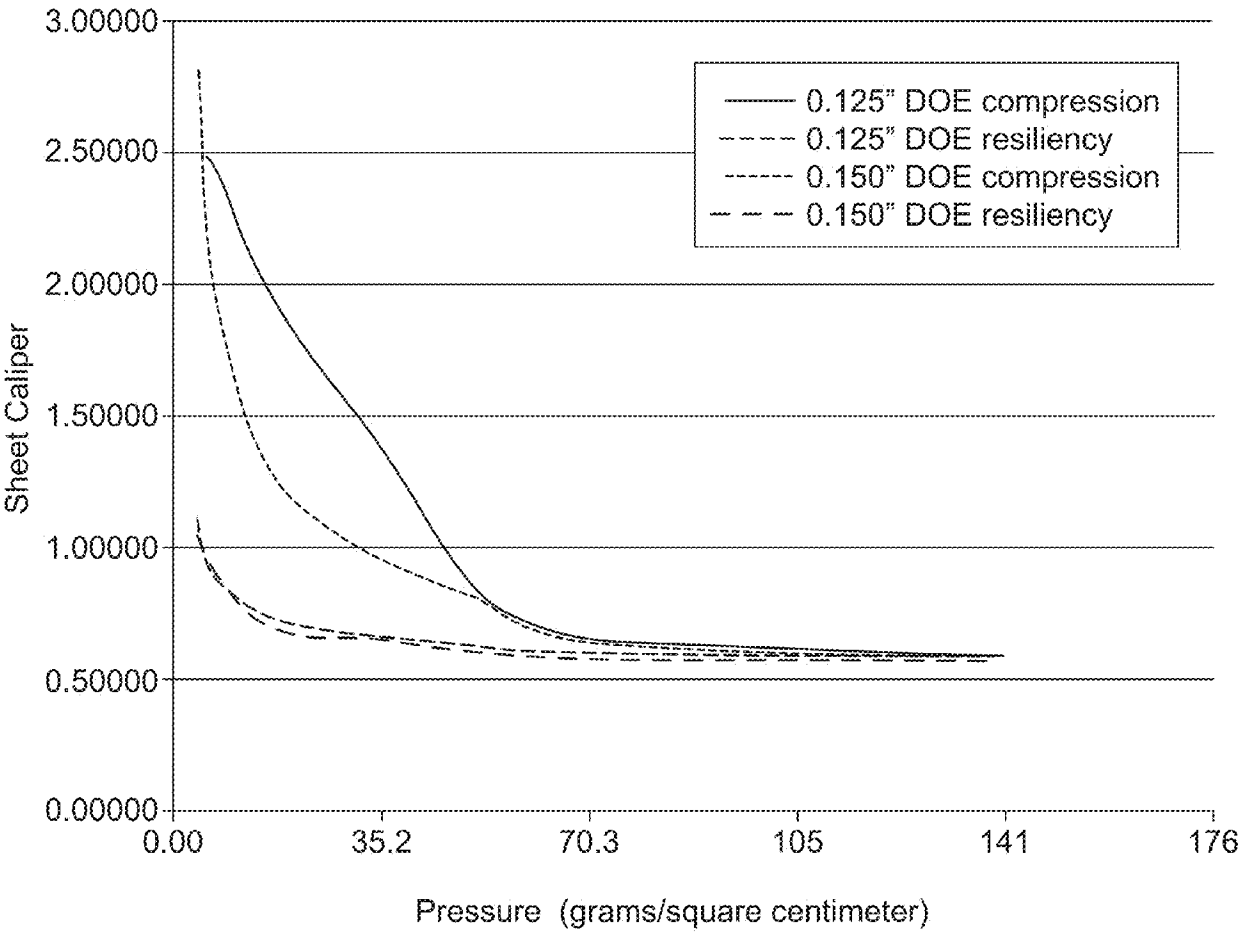
FIG. 3 is a graphical representation of the resiliency of four of the cleaning pads of FIG. 2.

Referring to FIG. 3, the protuberances (18) may have a first compressed height at 4.14 kpa of 0.65+/−0.1 mm. The protuberances (18) may have an uncompressed height at 1.65 kpa of 0.65+/−0.2 mm, and more particularly an uncompressed height at 1.65 kpa of 0.65+/−0.1 mm.

It can be seen that protuberances (18) of the aforementioned free height and with first compressed/uncompressed heights at these varying pressures unexpectedly provide superior cleaning performance.

The topsheet (12) may be formed from a generally planar, two dimensional nonwoven precursor web using a known apparatus. The apparatus may be oriented for continuous web processing with respect to a machine direction (MD) and having a cross machine direction (CD) as is commonly known in the art of nonwoven webs.

If desired, a nonwoven topsheet (12), or a topsheet (12) made of other material, may be made by passing the material through interengaged forming rolls having axially spaced, alternating radial teeth and intervening grooves, as illustrated in commonly assigned U.S. Pat. No. 6,383,431. If desired, a zero-strain laminate may be used for the topsheet (12), as disclosed in commonly assigned U.S. Pat. No. 5,143,679.

The apparatus may particularly comprise a pair of rolls, each rotating about parallel axes. The apparatus may comprise a pattern roll and a bed roll. Such an apparatus may be similar to the apparatus described in commonly assigned U.S. Pat. Nos. 5,916,661; 5,628,097 and 5,518,801 issued to Chappell et al. and U.S. 2004/0127875 published in the name of Hammons et al. The apparatus may comprise a roll having a plurality of circumferentially-extending ridges separated by grooves, as disclosed in the above-mentioned patents and is well known in the art of "ring rolling." One roll of the apparatus may have toothed ridges separated by grooves. The ridges of the pattern roll intermesh with the grooves of the facing roll to form the protuberances (18).

If a single pattern roll and bed roll are used, the pattern roll may provide a depth of engagement ranging from 3.1 to 3.5 mm, particularly from 3.2 to 3.4 mm. A single pattern roll/bed roll apparatus may be run at a line speed ranging from 5 to 1000 meters per minute and may particularly be 50 meters per minute.

If desired, the apparatus may comprise a single bed roll with a plurality of pattern rolls circumferentially spaced therearound. Or the apparatus may comprise plural pattern rolls and plural bedrolls. One, two, three, four or more pattern rolls equally or unequally spaced apart may be utilized. The apparatus line speed may range from 120 to 300 meters per minute.

Each pattern roll may provide successively deeper engagement between the nubs of that pattern roll and the bed roll. By deforming the protuberances (18) of the topsheet (12) in plural steps, rather than in a single step, it is believed the protuberances (18) have improved stiffness and resiliency, and thereby provide improved cleaning. In one exemplary embodiment, the pattern rolls may provide successively increasing depths of engagement of 1.9, 2.0 and 3.2 mm, respectively. The process of making a topsheet (12) using plural deformation steps, by, for example, using plural pattern rolls to successively deform the protuberances (18) more deeply is hereinafter referred to as a multi-hit deformation process.

The pattern rolls may have nubs of otherwise identical size and spacing. The nubs, and resulting protuberances (18), may be unilaterally staggered or bilaterally staggered. The nubs may have a height ranging from 1.5 to 3.0 mm. The nubs may have a length in the MD ranging from 5 to 7 mm. The nubs may be spaced on a pitch ranging from 1.5 to 5 mm, and particularly 4 mm in the CD and 4 to 15 mm, and particularly 12 mm in the MD. The nubs may or may not pierce the topsheet (12) material to form an apertured or nonapertured topsheet (12), as desired.

One advantage of the apparatus described above is that the topsheet (12) can be produced in-line with other production equipment on a manufacturing line for producing such articles. For example, an apparatus such as disclosed above, can be made as a unit operation for an existing manufacturing line. As a unit operation, such apparatus can be modular, so that it can be easily changed out. When used as part of a manufacturing line for cleaning pads (10), the constituent rolls need not be much wider than the product itself, thereby providing for relatively easy installation and removal. Various patterns can therefore be implemented with a minimum interruption to production.

The topsheet (12) may be generally manufactured according to the teaching of commonly assigned U.S. application Ser. No. 13/289,331, P&G Case 12296, now U.S. Pat. No. 9,204,775. The topsheet (12) may particularly be made according to the description of the scrubbing strip in this application, which description is particularly found at FIGS. 3-4D and page 12, line 21-page 14, line 26.

Referring back to FIGS. 1A-1B, the topsheet (12) may be white. The topsheet (12), core (14) and/or backsheet (16) may be printed with graphics, brand information, trademarks, usage instructions, and the like. The protuberances (18) may be of differential height, so that protuberances (18) of a particular height form an indicium.

The core (14) may be any desired color, such as blue, which contrasts with white. The topsheet (12) or backsheet (16), if present, may be white, or lighter in color than the core (14). This arrangement provides the benefit of allowing generally lighter colored soap scum removed from shower surfaces to contrast with the core (14), alerting the user to cleaning progress.

A blue core (14) may have Lab color values which change during cleaning as shown in Table 2 below.

TABLE 2

| dE = 2.14 | | | |
|---|---|---|---|
| | L | A | b |
| Pre-cleaning | 77.34 | −1.49 | −5.17 |
| After cleaning | 79.4 | −2 | −5.17 |

A white topsheet (12) or core (14) may have Lab color values which change during cleaning as shown in Table 3 below.

TABLE 3

| dE = 0.33 | | | |
|---|---|---|---|
| | L | a | b |
| Pre-cleaning | 79.2 | −0.04 | −1.8 |
| After cleaning | 79.1 | −0.2 | −2.04 |

A suitable core (14) may be of any desired color and have an L value of 70 to 85, 74-80 and particularly 77.

A sample of a cleaning pad (10) according to the present invention, having a blue core (14)/white topsheet (12) was tested for color change of the [core (14)/topsheet (12)/both?] after laboratory cleaning simulation. A hand made sample having a white core (14)/white topsheet (12) and three controls, each having a white topsheet (12)/colored core (14) was also tested. N=4 samples were tested for each run.

The laboratory simulation used a machine having constant stroke length/speed and constant pressure applied to the pad (10). The simulation used a smooth steel target surface coated with a white soap spray dried thereon.

Figure 4:
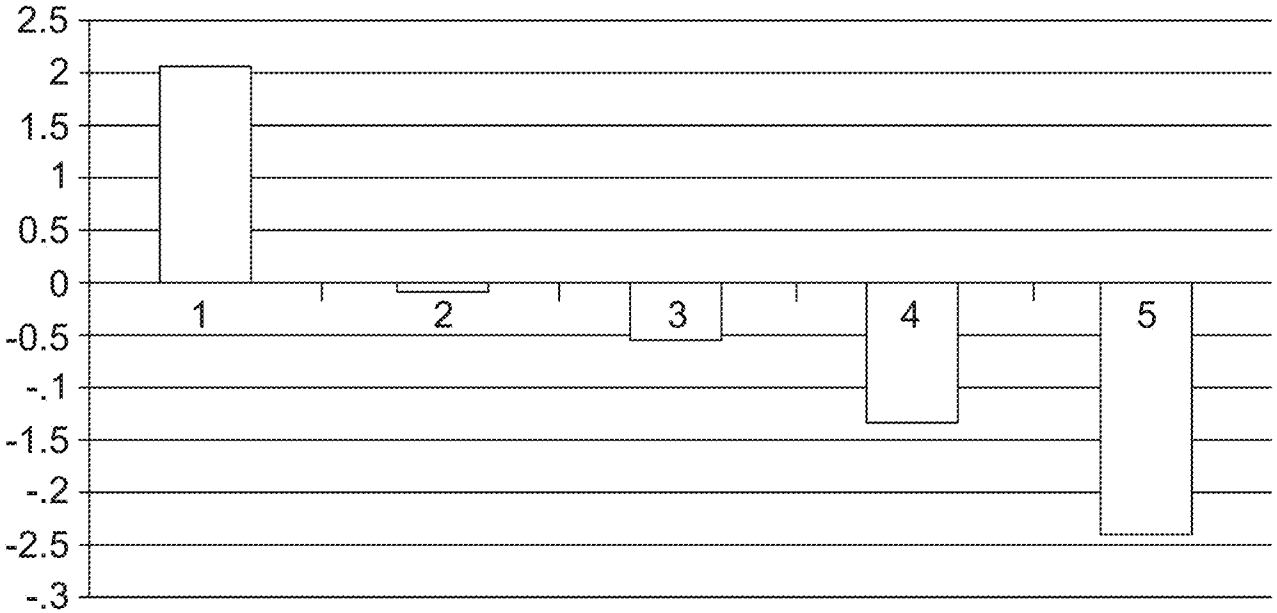
FIG. 4 is a graphical representation of the change in color of a pad according to the present invention and four control pads after a laboratory cleaning task.

Referring to FIG. 4 and Table 4, the results are shown. These results show that the invention increased in dL, while all other samples tested decreased in dL. These data show the invention unexpectedly provides the benefit that the cleaning pad (10) according to the invention appears lighter after use, alerting the user that the usable life of the cleaning pad (10) may be depleted. In contrast, no such visual signal occurs with the controls or hand-made sample.

TABLE 4

| Sample | Delta L | Legend on FIG. 4 |
|---|---|---|
| Invention: White topsheet (12)/ blue core (14) | 2.06 | 1 |
| Handmade: White topsheet (12)/white core (14) | −0.1 | 2 |
| Control: White topsheet (12)/ pink core (14) | −0.56 | 3 |
| Control: White topsheet (12)/ blue core (14) | −1.36 | 4 |
| Control: White topsheet (12)/ yellow core (14) | −2.44 | 5 |

The core (14) may provide storage for cleaning solution and debris collected during the cleaning task. The core (14) may hold, transport and/or absorb cleaning solution during cleaning and help to create suds. If desired, the core (14) may have a color, such as blue, green or any other color, to signal when the pad (10) is used and no longer suitable for further cleaning.

This cleaning pad (10) may have an absorbent capacity of at least 10, 15, or 20 grams of cleaning solution per gram of dry cleaning pad (10) and may have other absorbent properties, as set forth in commonly assigned U.S. Pat. Nos. 6,003,191; 6,048,123 and 6,601,261.

The core (14) may be a carded thermally bonded high loft nonwoven. The nonwoven may comprise 70 w % PET staple fibers and 30 w % latex binder. The nonwoven may comprise PET containing bicomponent fiber with PP, PE, Nylon, Rayon, cellulose and mixture thereof. The basis weight of the center lamina may be 60 to 100, 80 to 90 and particularly 85 gsm having a thickness of 2.5 mm.

The core (14) may optionally comprise absorbent gelling materials to increase the absorbent capacity of the cleaning pad (10). The absorbent gelling materials may be distributed within the cleaning pad (10) in such a manner to avoid rapid absorbency and absorb fluids slowly, to provide for the most effective use of the cleaning sheet.

The backsheet (16), maybe liquid impervious in order to minimize loss of absorbed fluids. The backsheet (16) may further provide for releasable attachment of the cleaning pad (10) to an optional cleaning implement.

The backsheet (16) may comprise a nonwoven, or may comprise two plies joined together in face to face relationship. Such two plies may comprise a polyolefinic film and/or textile fabric joined together with the textile fabric facing towards the core (14). More particularly, the textile fabric may comprise a knitted nylon material. The backsheet (16) may be made of a polyolefinic film, such as LDPE. One suitable backsheet (16) is a polethylene film having 29 gsm nylon loops joined thereto to form a laminate. The film may comprise PE or similar impervious material. The total basis weight of the two plies in the backsheet (16) may be 30 to 60 and particularly 50 gsm.

The topsheet (12) and backsheet (16) of the pad (10) may be peripherally joined, to capture the core (14) therebetween. This arrangement provides the benefit that the periphery of the pad (10) may be more flexible than the portion of the pad (10) having the core (14). Increased flexibility allows the edge of the pad (10) to further reach into corners and conform to other irregularities. Alternatively, all three may be perimetrically joined together.

Bonding may be accomplished with adhesive joining between all plies. The adhesive bonding may be throughout the entire surface of the plies.

The pad (10) may be used with a cleanser. The cleanser may be liquid, foam, gel or a combination thereof with or without particulates suspended therein. If desired, liquid cleanser may be provided in an aerosol container, or trigger sprayer, as are known. An aerosol container may be metal, plastic such as PET, etc. and may be removably inserted into a complementary receptacle in the handheld device. Suitable liquid cleansers may comprise surfactants, organic acids, chelating agents, pH adjusting compounds, perfumes, disinfectants, anti-microbials, preservatives. etc.

The cleanser may comprise an aqueous detergent composition. This composition may contain C6 to C16, or more particularly C8 and/or C10 alkyl sulfate detergent surfactants, optional hydrophobic solvents, optional anionic surfactants, optional peroxide, optional hydrophilic solvent, optional mono- or poly-carboxylic acid and/or optional aqueous solvent systems. The pH may be any suitable value, and may range from 2 to 5. The cleanser may be made according to the teachings of commonly assigned U.S. Pat. No. 6,627,590.

In a variant embodiment, the pad (10) according to the present invention may be premoistened. A pre-moistened cleaning pad (10) may comprise one or more layers of natural or synthetic fibers. The fibers may be hydrophilic, hydrophobic or a combination thereof, provided that the cleaning pad (10) is generally absorbent to hold, and express upon demand, a cleaning solution. In one embodiment, the cleaning pad (10) may comprise at least 50 weight percent or at least 70 weight percent cellulose fibers, such as air laid SSK fibers. Prophetically a pad (10) usable with the present invention could comprise one or more layers of scrim, foam, sponge, etc. to assist in scrubbing.

The cleaning pad (10) may be loaded with at least 1, 1.5 or 2 grams of cleaning solution per gram of dry substrate, but typically not more than 15 grams per gram. The cleaning solution may comprise a surfactant, such as an alkylpolyglucoside APG surfactant which minimizes streaking since there is typically not a rinsing operation, agglomerating agents, buffering agents, disinfectants, antimicrobials, bleaching agents, enzymes, perfumes, secondary surfactants, etc. A suitable pre-moistened cleaning pad (10) may be made according to the teachings of commonly assigned U.S. Pat. Nos. 6,653,274; 6,716,805; D551,409 S and/or D614,408 S.

Optionally, the cleaning pad (10) may further comprise an additive, to improve cleaning performance and/or enhance the cleaning experience. The additive may comprise wax, such as microcrystalline wax, oil, adhesive, perfume and combinations thereof. The cleaning pad (10) according to the present invention may be made according to commonly assigned U.S. Pat. Nos. 6,305,046; 6,484,346; 6,561,354; 6,645,604; 6,651,290; 6,777,064; 6,790,794; 6,797,357; and 6,936,330;

The cleaning pad (10) may be hand held and used with manual manipulation. Alternatively, the cleaning pad (10)

may be used with a hand held device, such as a foam handle. The foam may comprise melamine and or polyurethane, as desired. A suitable device is shown in commonly assigned U.S. D640,580. The cleaning pad (10) may be releasably attachable to such a device using hook/loop fasteners. Or the device may comprise grippers, having resiliently deformable cantilevered fingers and/or a loop handle, as disclosed in commonly assigned U.S. D578,720.

The device may have an elongate handle, to improve reach. The elongate handle may be attached to the head onto which the cleaning pad (10) is removably attached, using a universal joint, as is well known. A suitable device is found in commonly assigned U.S. Pat. No. 7,536,743.

The device may have a sole plate (20) to which the cleaning pad (10) is removably attached. Above the sole plate (20), the device may further comprise a receptacle for receiving a supply of the cleaning solution. The receptacle may be disposed within the handle. The device may be generally made according to the teachings of commonly assigned DEVICE FOR TREATING A TARGET SURFACE U.S. application Ser. No. 12/911,932 filed Oct. 26, 2010, US 2012-0096662 A1, now U.S. Pat. No. 8,684,619 "CLEANING DEVICE HAVING PLURAL AND CUSTOMIZABLE CLEANING SURFACES" Ser. No. 13/094,559 filed Apr. 26, 2011, now U.S. Pat. No. 8,708,687, U.S. application Ser. No. 13/094,593 filed Apr. 26, 2011, 2012-0277701 A1 and now pending, and U.S. application Ser. No. 12/911,932 filed Oct. 26, 2010, now U.S. Pat. No. 8,684,619.

The pad/device may be used with an outboard cleanser, such as a spray bottle or aerosol dispenser, as is well known in the art. Or the device may have an onboard dispenser. The device may have a reservoir of cleaning solution or one or more containers of cleaning solution. The cleaning solution or container thereof may have a volume of less than 250, 200, 150, or 100 ml. The device may have a weight of, less than 750, 700, 650, 600, 550, 500, 450, 400, 350, 300, or 250 grams with the container of cleaning solution and the pad (10) installed. Such a relatively light weight is particularly suitable for a cleaning device having a handle intended for single hand operation. If the device has an elongate handle, the device may be slightly heavier, due to the two-handed operation possible with the elongate handle.

To keep the center of gravity near the handle, the device may have a container installed within the receptacle. The receptacle, and any container installed therein may be intermediate the top of the sole plate (20) and the handle. The receptacle, and any container installed therein may be disposed above the bottom of the sole plate (20) and within the handle. This arrangement provides a center of gravity disposed juxtaposed with center of the device.

The sole plate (20) may be flexible and bend, compress or otherwise deform into corners and other irregular surfaces under normal usage forces. The sole plate (20) may be resiliently deformable. By resiliently deformable it is mean that at least a portion of the sole plate (20) deforms, bends or otherwise conforms to a target surface under ordinary compressive forces applied in use, and returns to substantially its original shape when the compressive force is removed.

The bottom of the sole plate (20) may comprise one or more features which accommodate removable placement of the pad (10) thereon. The pad (10) may be discarded at the end of the cleaning task, during the cleaning task and replaced with a fresh pad (10) if necessary, or may be replaced with a different pad (10) better suited to a particular cleaning task.

The replaceable pad (10) may be removably attached to the bottom of the sole plate (20) using hook and loop type fasteners, adhesive disposed on the replaceable pad (10) and combinations thereof. The hook fasteners may be molded into the bottom of the sole plate (20) and the complementary loop material may be provided by the replaceable pad (10) and inherent in the material thereof. If grippers are used with the cleaning implement, the grippers may be made according to commonly assigned U.S. Pat. Nos. 6,305,046; 6,484,346; 6,651,290 and/or D487,173.

The front of the device may have a point, for reaching into corners. The back of the device may comprise a receptacle for receiving a supply of the cleaning solution. Alternatively, the receptacle for the cleaning solution may be disposed on the top of the device. For example, the handle may be hollow and comprise a reservoir to be the receptacle to contain the cleaning solution. If desire the receptacle, and container each may have a longitudinal axis, which axis is coincident the longitudinal axis of the device.

The front of the device may comprise a permanent cleaning material. Permanent cleaning materials include those which are replacable after years of use, for example using a modular construction. The permanent cleaning material may last for the life of the device and does not need replacement after one or a few cleaning tasks. The permanent cleaning material may come to a point, for reaching into corners or other tight spaces. The permanent cleaning material may comprise foam, textured polyolefinic film, nonwoven scrubbie material, steel wool, a squeegee, asperities in the hard plastic of the device, bristles and combinations thereof.

Bristles may be disposed at the front of the device, being cantilevered from proximal ends and extending to distal ends which contact the target surface. The bristles may be permanent, so that replacement thereof during the life of the device is unnecessary.

The cleaning solution may be sprayed from the device or container through any suitable nozzle or plurality of nozzles. In one embodiment, the cleaning solution may be forwardly sprayed in a fan pattern from a nozzle coincident the longitudinal axis. Alternatively, the cleaning solution may be sprayed forward and laterally from a pair of nozzles offset from the longitudinal axis. Alternatively, the nozzle may be disposed in the handle, to provide more elevation of the spray pattern from the target surface. Or one or more nozzles may be disposed on the bottom of the sole plate (20). The nozzle may also be a simple opening, to provide a dribble of the cleaning solution or may provide a spray, as is known in the art.

The container of cleaning solution may be removably inserted into the receptacle by sliding the container forward. The container may be cylindrically shaped as is common in the art, and disposed in the receptacle generally parallel to the longitudinal axis. This arrangement provides improved lateral balance to the device, by concentrating the weight of the cleaning solution supply on the longitudinal axis. The improved lateral balance likewise improves user ergonomics.

The container may be an aerosol container, as is known in the art. This aerosol container may use a bag on valve configuration, as is commonly known in the art. The bag on valve configuration has a bag containing cleaning solution to be dispensed onto the target surface. Propellent is disposed within the container on all sides of the bag, providing pressure on all sides of the bag. This arrangement provides the benefit that the device can be held, used and contact the target surface in any position and concurrently dispense cleaning solution, allowing the cleaning task to continue uninterrupted.

If desired, the device may have plural cleaning solutions mixed at the point of use. For example a first cleaning solution may be contained in an aerosol container and a second cleaning solution may be contained in a hollow handle. Additionally or alternatively, hollow handle may have a receptacle divided into plural compartments. The plural compartments may contain identical, complementary or other mutually different cleaning solutions.

When the replaceable pad (10) becomes too soiled for efficacious cleaning, it may simply be removed from the sole plate (20) and discarded. A new efficacious pad (10) may then be attached to a space on the bottom of the sole plate (20) and deployed for cleaning.

The cleaning pad (10) of the present invention may be removably attached to a floor cleaning device, as sold by the instant assignee under the Swiffer trademark. Such device may spray cleanser as taught in commonly assigned U.S. Pat. No. 6,986,619 or be used with dry pads (10) as taught in commonly assigned Des. 423,742.

The pad (10) according to the present invention, cleaning solution and/or device may be sold in a kit form. The kit may have a device having a permanent cleaning material intended for prolonged and several uses. One or more pads (10) may be included in the kit form. The pads (10) may be mutually identical or may be different, allowing for customizing the cleaning solution choice for a particular task.

The cleaning device may have hooks (22), which engage complementary loops on the cleaning device. The hooks (22) may be disposed on the sole plate (20) or other outwardly facing surface of the cleaning device which removably receives the cleaning pad (10). If desired, adhesive attachment may be used in place of the hook/loop fasteners.

The removal force may be measured as a peel force. Peel force is measured by providing a suitable cleaning device, complementary to and able to removably receive the cleaning pad (10).

Figure 5:
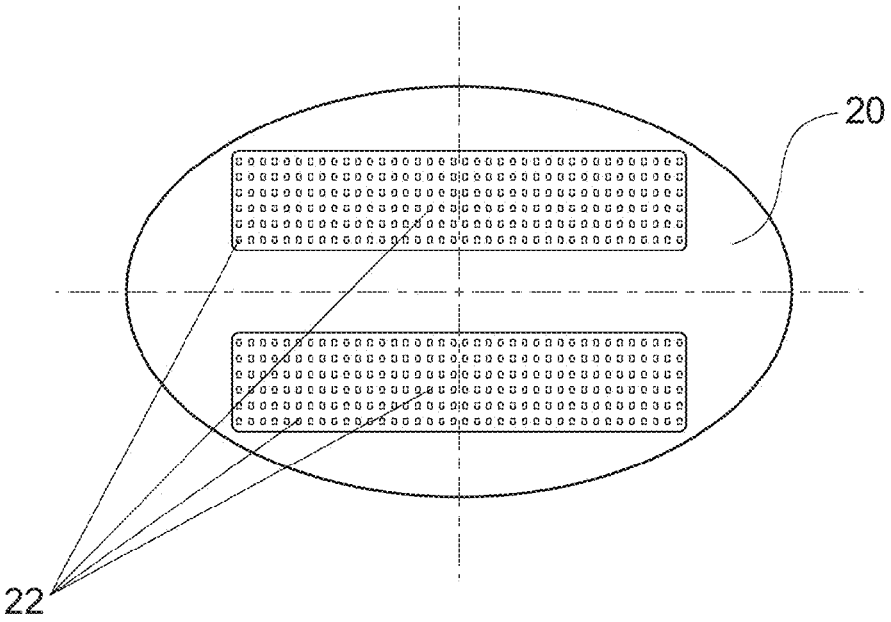
FIG. 5 is a bottom plan view of an exemplary sole plate usable with cleaning pads of the present invention.

Referring to FIG. 5, the cleaning device may have a sole plate (20). The sole plate (20) may be flat and able to removably receive the pad (10) thereon, particularly having the backsheet (16) in contacting relationship with the sole plate (20). The sole plate (20) has a generally elliptical shape as shown, with an area of 102.3 square centimeters.

The sole plate (20) may be provided with one or patches of hooks (22). The hooks (22) may be distributed in one or more patches. For the Full Pad Peel Force test described below, the sole plate (20) is provided with two longitudinally oriented patches of hooks (22), each patch having a footprint of 73×12 mm and being spaced apart 10 mm, providing a total hook (22) area of 17.52 square centimeters.

Figure 6:
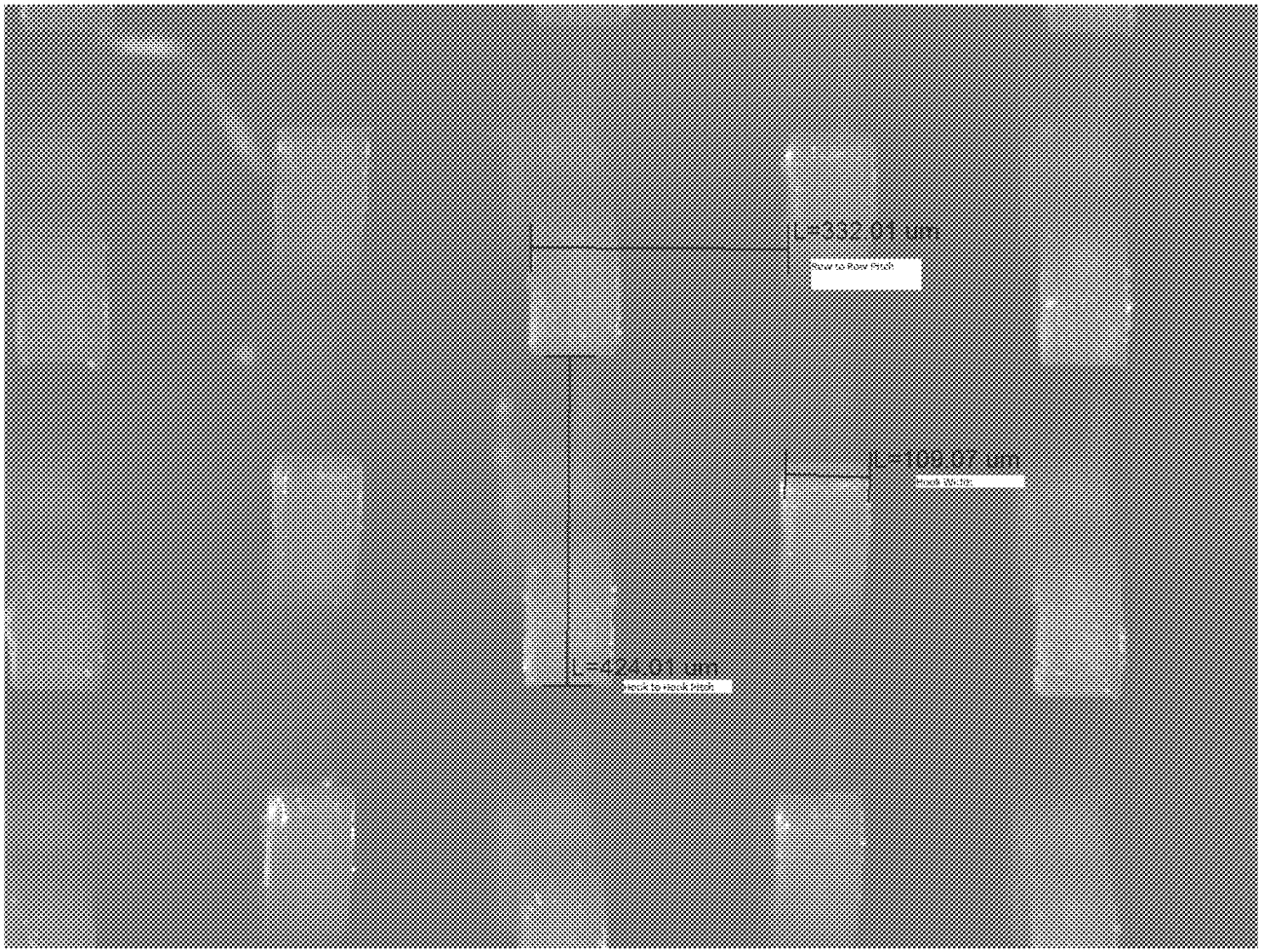
FIG. 6 is a top plan photomicrograph of hooks usable with the sole plate of the present invention.
Figure 7:
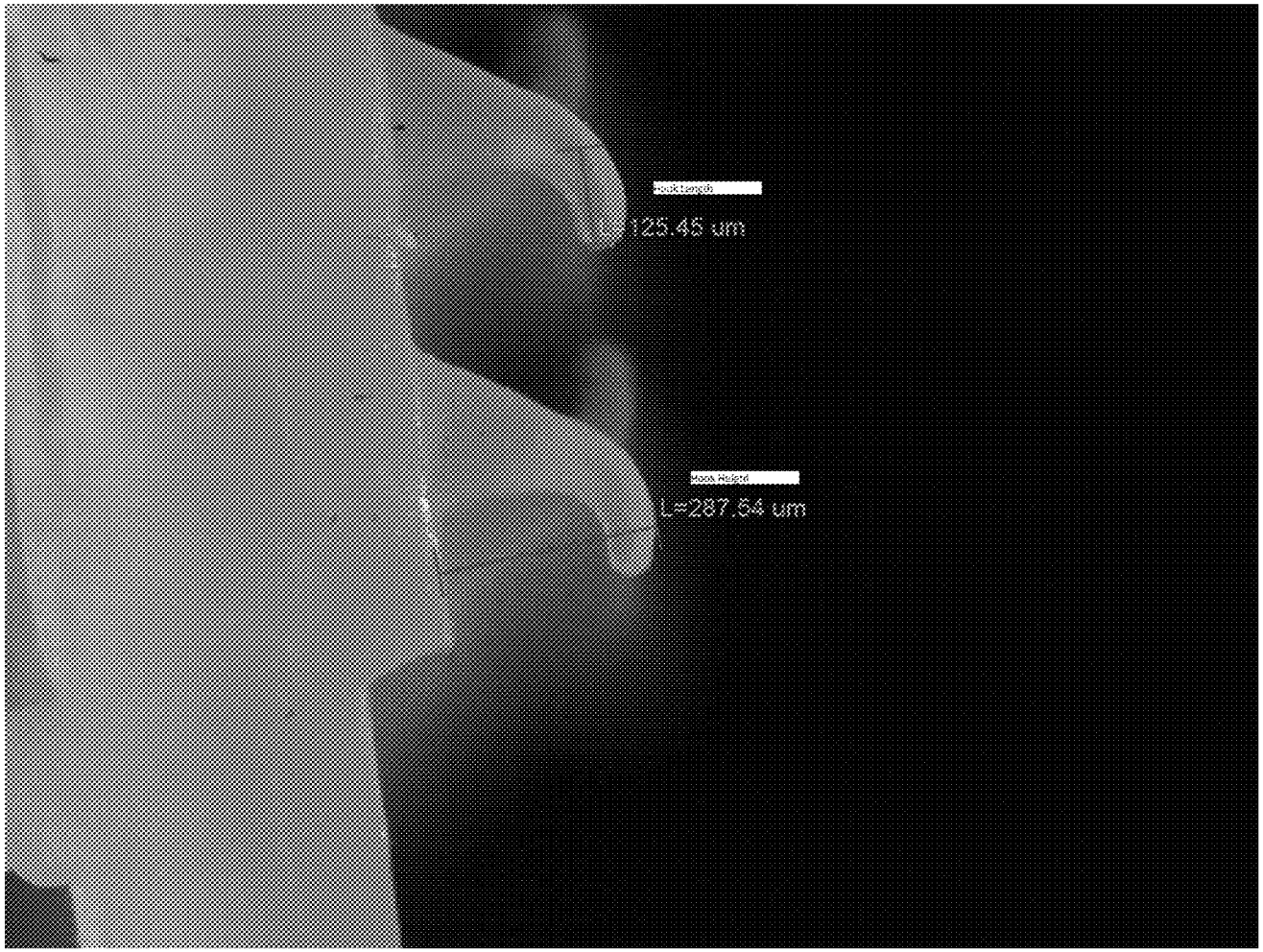
FIG. 7 is a side elevational photomicrograph of two hooks usable with the sole plate of the present invention.

Referring to FIGS. 6-7, each patch has eight longitudinally oriented rows of hooks (22), with 64 hooks (22) in each row for a total of 512 hooks per patch. These hooks (22) are oriented in the transverse direction, and perpendicular to the longitudinal direction. Adjacent hooks (22) in a row are alternatingly oriented 180 degrees apart. Applicants have found that closely spaced hooks (22), i.e. spaced less than 2 mm, less than 1.7 or less than 1.5 mm in each direction from the adjacent hooks (22) and having a height less than 1.5 mm, less than 1.3 mm or less than 1.0 mm provide sufficient resistance to the shear forces encountered in use without undue removal forces when the cleaning pad (10) is to be discarded.

The hooks may have the geometry and spacing shown in Table AAA below.

TABLE AAA

| Hook Feature | Length (mm) |
|---|---|
| Hook to Hook Pitch | 1.48 |
| Row to Row Pitch | 1.16 |
| Hook Width | 0.38 |

TABLE AAA-continued

| Hook Feature | Length (mm) |
|---|---|
| Hook Height | 1.01 |
| Hook Length | 0.44 |
| Hook Thickness | 0.24 |
| Hook Radius | 0.37 |

The hooks may provide shear, peel and tensile strengths, measured according to Test Method NF G91 103 as shown in Table AA below.

TABLE AA

| NF G91 103 with Aplix 200 Loop | | |
|---|---|---|
| Test | Results | Units |
| Shear (parallel to plane) | 17.12 | N/square centimeter |
| Peel (90 degrees) | 3.39 | N/centimeter |
| Tension (perpendicular to plane) | 6.60 | N/square centimeter |

The cleaning pad (10) is placed onto a rigid flat surface with the backsheet (16) facing upwardly. A sole plate (20), having a footprint matching that of the backsheet (16) is then applied to the backsheet (16) for 5 seconds under a uniformly applied pressure of 5.13 kPa. For a sole plate (20) having an area of 102.3 square centimeters, compressive force of 5.36 kg is applied. Therefore the compressive force applied to the pad (10) is distributed across the entire area of the sole plate (20) of the device. If no backsheet (16) is present, the core (14) or topsheet (12) (if no core (14) is present) is attached to the sole plate (20).

The sole plate (20) with pad (10) attached is rigidly mounted onto the crosshead of a tensile machine with the sole plate (20), or other pad (10) receiving surface facing upwardly and horizontal. A straight edge, parallel to the 73 mm dimension, is attached to the other crosshead of the tensile machine, taking care not to disrupt any engaged hook/loops.

The cross heads are separated at a speed of 25.4 cm per minute. The separation results in a 90 degree peel of the cleaning pad (10) from the cleaning device. The maximum peel force is then recorded to the nearest gram. This force is recorded as the Full Pad (10) Peel Force.

One of skill will recognize that peel force will directly vary with the width of the face presented to the cross head separation. Accordingly, one may use a cleaning pad (10) sample having a straight width of 24, 48 or 73 mm Hook (22) material may be cut to size, as needed. This width, as presented to the tensile direction, is referred to as the peel face. The peel force obtained therefrom may be scaled to the desired force, depending upon the total footprint of hooks (22) used in the cleaning device. If the hook (22) properties are anisotropic, the hook (22) material is tested in all relevant directions.

Referring to the tables below, samples were tested to determine adequate, high and low peel forces according to the aforementioned procedure. Each sample was tested five times and the results therefor averaged. The same sole plate (20) having an area of 102.3 square centimeters was used for each test. This sole plate (20) had Aplix brand hooks (22) disposed in two patches of 73×24 mm with a 10 mm gap therebetween.

Table A shows the results for a results for a cleaning pad (10) having a backsheet (16) comprising a polyethylene film with nylon loops attached thereto, forming a 29 gsm laminate. Table B shows the results for a 45 gsm polypropylene hydroentangled spun bond material, subjectively judged to have a peel force less than desired. Table C shows the results for a durable Velcro brand material, subjectively judged to have a peel force greater than desired.

TABLE A

| | Full Pad Peel Force | 73 mm Peel Face | 48 mm Peel Face | 24 mm Peel Face |
|---|---|---|---|---|
| Sample Number | | | | |
| 1 | 684 | 434 | 540 | 403 |
| 2 | 830 | 521 | 408 | 242 |
| 3 | 585 | 380 | 383 | 217 |
| 4 | 641 | 574 | 409 | 223 |
| 5 | 699 | 583 | 293 | 311 |
| Test Results | | | | |
| Average (g) | 688 | 498 | 407 | 279 |
| Std. Dev | 91 | 89 | 88 | 78 |
| Force per mm of Loop (g/mm) | 9.6 | 6.9 | 8.5 | 11.6 |

TABLE B

| | Full Pad Peel Force | 73 mm Peel Face HESB | 24 mm Peel Face HESB |
|---|---|---|---|
| Sample Number | | | |
| 1 | 263 | 170.65 | 112.405 |
| 2 | 203 | 202.249 | 66.578 |
| 3 | 555 | 203.995 | 53.599 |
| 4 | 298 | 180.946 | 36.373 |
| 5 | 261 | 188.292 | 64.054 |
| Test Results | | | |
| Average (g) | 279 | 189 | 67 |
| Std. Dev | 78 | 14 | 28 |
| Force per mm of Loop (g/mm) | 11.6 | 2.6 | 2.8 |

TABLE C

| | 73 mm Peel Face Durable Velcro | 24 mm Peel Face Durable Velcro |
|---|---|---|
| Sample Number | | |
| 1 | 1012 | 422 |
| 2 | 717 | 471 |
| 3 | 875 | 440 |
| 4 | 630 | 415 |
| 5 | 578 | 556 |
| Test Results | | |
| Average (g) | 762 | 461 |
| Std. Dev | 179 | 58 |
| Force per mm of Loop (g/mm) | 10.6 | 19.2 |

For the embodiments described and claimed herein, a cleaning pad (10) and/or cleaning pad/device combination having a 24 mm Peel Face force of 100 g-400 g, particularly 150 g to 350 g and more particularly about 250 grams peak peel force may be utilized. For the embodiments described and claimed herein, a cleaning pad (10) and/or cleaning pad/device combination having a 72 mm Peel Face force of 300 g to 700 g, particularly 400 g to 600 g and more particularly about 500 grams peak peel force may be utilized. The total 90 degree peel force to remove the pad (10) from the device may range from 325 g to 725 g and more particularly from 450 to 700 grams.

If the peel force is too great, unintended tearing of the cleaning pad (10) may result. If the peel force is too small, foldover or dislodging may occur during use. Accordingly it is desired the cleaning pad (10) have a total removal force within the aforementioned ranges.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A cleaning device in combination with and having a disposable cleaning pad removably attachable thereto, said cleaning device having:

a sprayer to dispense cleaning fluid therefrom, a sole plate to removably receive said cleaning pad and being joined to said sprayer, wherein said cleaning pad is removably attachable to said sole plate with a 90 degree peel force of 325 to 725 grams.

2. A cleaning device in combination with and having a disposable cleaning pad removably attachable thereto, according to claim 1, wherein said cleaning pad is removably attachable to said sole plate with a 90 degree peel force of 450 to 700 grams.

3. A cleaning device in combination with and having a disposable cleaning pad removably attached thereto according to claim 2, said cleaning pad comprising a floor sheet and backsheet joined thereto, wherein said sole plate has hook fasteners thereon, said hook fasteners, engaging loops on said backsheet.

4. A cleaning device in combination with and having a disposable cleaning pad removably attached thereto, according to claim 3 wherein said hook fasteners are disposed in two longitudinally oriented patches oriented in a longitudinal direction.

5. A cleaning device in combination with and having a disposable cleaning pad removably attachable thereto, according to claim 4 wherein each said patch has a footprint of 73 mm×12 mm.

6. A cleaning device having a longitudinal direction in combination with and having a disposable cleaning pad removably attached thereto, according to claim 4 wherein said hook fasteners of said patch are oriented in a transverse direction perpendicular to said longitudinal direction.

7. A cleaning device in combination with and having a disposable cleaning pad removably attached thereto, according to claim 3 wherein said hook fasteners are spaced less than 2 mm from adjacent hook fasteners.

8. A cleaning device in combination with and having a disposable cleaning pad removably attached thereto, according to claim 7 wherein said hook fasteners have a height less than 1.5 mm.

9. A cleaning device in combination with and having a disposable cleaning pad removably attached thereto, according to claim 2, wherein said sole plate and said pad are removably adhesively attached to each other.

10. A cleaning device in combination with and having a disposable cleaning pad removably attachable thereto, said cleaning device having:

a sprayer to dispense cleaning fluid therefrom, a sole plate to removably receive said cleaning pad and being joined to said sprayer, wherein said cleaning pad is removably attachable to said sole plate with a having a 24 mm Peel Face force of 100-400 grams.

11. A cleaning device in combination with and having a disposable cleaning pad removably attachable thereto, according to claim 10 having a 24 mm Peel Face force of 150-350 grams.

12. A cleaning device in combination with and having a disposable cleaning pad removably attachable thereto, said cleaning device having:

a sprayer to dispense cleaning fluid therefrom, a resiliently deformable sole plate to removably receive said cleaning pad and being joined to said sprayer, wherein said cleaning pad is removably attachable to said sole plate with a having a 72 mm Peel Face force of 300 to 700 grams.

13. A cleaning device in combination with and having a disposable cleaning pad removably attachable thereto, according to claim 12 having a 72 mm Peel Face force of 400 to 600 grams.

* * * * *